US010975621B2

(12) United States Patent
Gentil

(10) Patent No.: US 10,975,621 B2
(45) Date of Patent: Apr. 13, 2021

(54) SECURITY GATE WITH CLOSER SYSTEM

(71) Applicant: Dorel Juvenile Group, Inc., Foxboro, MA (US)

(72) Inventor: Jean-Luc Gentil, Cholet (FR)

(73) Assignee: Dorel Juvenile Group, Inc., Foxboro, MA (US)

( * ) Notice: Subject to any disclaimer, the term of this patent is extended or adjusted under 35 U.S.C. 154(b) by 238 days.

(21) Appl. No.: 16/131,336

(22) Filed: Sep. 14, 2018

(65) Prior Publication Data

US 2020/0087964 A1 Mar. 19, 2020

(51) Int. Cl.

| | |
|---|---|
| ***E06B 11/02*** | (2006.01) |
| ***E05C 1/12*** | (2006.01) |
| ***E05B 65/00*** | (2006.01) |
| ***E06B 9/04*** | (2006.01) |
| ***E05F 1/06*** | (2006.01) |
| ***E05F 1/12*** | (2006.01) |
| *E06B 9/00* | (2006.01) |

(52) U.S. Cl.

CPC ..... *E06B 11/02* (2013.01); *E05B 65/0007* (2013.01); *E05B 65/0014* (2013.01); *E05C 1/12* (2013.01); *E05F 1/06* (2013.01); *E05F 1/061* (2013.01); *E05F 1/063* (2013.01); *E05F 1/066* (2013.01); *E05F 1/1223* (2013.01); *E06B 9/04* (2013.01); *E06B 11/022* (2013.01); *E05Y 2900/40* (2013.01); *E06B 2009/002* (2013.01)

(58) Field of Classification Search

CPC ..... E06B 11/02; E06B 11/022; E06B 9/04; E06B 2009/002; E05F 1/1223; E05F 1/063; E05F 1/06; E05F 1/061

USPC ..... 49/236, 237, 239

See application file for complete search history.

(56) References Cited

U.S. PATENT DOCUMENTS

| | | | | |
|---|---|---|---|---|
| 165,619 | A * | 7/1875 | Sanderson | E05F 1/063 16/318 |
| 785,143 | A * | 3/1905 | Winter | E05D 11/0054 |
| 3,398,487 | A * | 8/1968 | Matyas | E06B 3/72 49/239 |
| 4,215,449 | A * | 8/1980 | Loikitz | E05F 1/063 16/303 |
| 5,138,743 | A * | 8/1992 | Hoffman | E05F 1/1223 16/303 |
| 5,442,881 | A | 8/1995 | Asbach et al. | |
| 6,516,568 | B2 | 2/2003 | Yang | |
| 6,715,182 | B2 * | 4/2004 | Cheng | E05F 1/063 16/280 |
| 7,320,152 | B2 | 1/2008 | Lowry et al. | |
| 7,540,046 | B1 * | 6/2009 | Lai | A47D 13/065 256/26 |

(Continued)

*Primary Examiner* — Marcus Menezes

(74) *Attorney, Agent, or Firm* — Barnes & Thornburg LLP

(57) ABSTRACT

A gate unit includes a gate mount adapted to mate with a frame bordering a passageway. The gate mount includes a gate hinge including a stationary pivot support and a movable pivot that is mated in rotative bearing engagement with the stationary pivot support to establish a gate-pivot axis. A gate is coupled to the movable pivot of the gate hinge for pivotable movement with the movable pivot about the gate-pivot axis between a closed position closing a walkway passage formed in the gate mount to block movement of a person through the walkway passage and an opened position opening the walkway passage to allow movement of a person through the walkway passage.

26 Claims, 9 Drawing Sheets

(56) References Cited

U.S. PATENT DOCUMENTS

| | | | | |
|---|---|---|---|---|
| 7,950,184 | B2 * | 5/2011 | Flannery | E06B 9/04 49/57 |
| 7,963,575 | B2 | 6/2011 | Mayo et al. | |
| 8,341,886 | B2 | 1/2013 | Yates | |
| 8,505,166 | B2 | 8/2013 | Mitchell et al. | |
| 8,615,928 | B2 * | 12/2013 | Wang | E04H 17/00 49/226 |
| 8,782,953 | B2 | 7/2014 | Bongiovanni | |
| 8,944,394 | B2 | 2/2015 | Berger | |
| 9,637,959 | B2 | 5/2017 | Marsden et al. | |
| 10,167,657 | B2 * | 1/2019 | Gompper | E06B 5/006 |
| 2002/0116788 | A1 * | 8/2002 | Pompei | E05F 1/063 16/315 |
| 2009/0064462 | A1 * | 3/2009 | Yin | G06F 1/1681 16/330 |
| 2010/0218342 | A1 * | 9/2010 | Bertolini | F25D 23/028 16/244 |
| 2012/0055092 | A1 * | 3/2012 | Boucquey | E05B 65/0014 49/192 |
| 2013/0180177 | A1 * | 7/2013 | Lazarevich | E05D 11/0054 49/399 |
| 2015/0075079 | A1 | 3/2015 | Sundberg et al. | |
| 2015/0089873 | A1 | 4/2015 | Marsden et al. | |
| 2015/0101253 | A1 | 4/2015 | Marsden et al. | |
| 2015/0259964 | A1 * | 9/2015 | Linehan | E05C 1/10 49/272 |
| 2017/0009503 | A1 * | 1/2017 | Gompper | A47B 97/00 |
| 2017/0058594 | A1 | 3/2017 | Marsden | |

* cited by examiner

SECURITY GATE WITH CLOSER SYSTEM

PRIORITY CLAIM

This application claims priority under 35 U.S.C. § 119(e) to U.S. Provisional Application No. 62/558,331, filed Sep. 14, 2017, which is expressly incorporated by reference herein.

BACKGROUND

The present disclosure relates to movable barriers. More particularly, the present disclosure relates to juvenile gates for inside a dwelling.

SUMMARY

A gate unit in accordance with the present disclosure includes a gate that can be moved about a gate-pivot axis by a person between OPENED and CLOSED positions. In illustrative embodiments, the gate unit also includes a gate lock that is movable relative to the gate to retain the gate in the CLOSED position and establish a locked mode of the gate.

In illustrative embodiments, the gate unit also includes a gate mount that is U-shaped and adapted to mate with a door frame bordering a doorway. The gate is mounted on upper and lower hinges included in the gate mount for pivotable movement about the gate-pivot axis between a CLOSED position closing a walkway passage formed in the gate mount to block movement of a person through the walkway passage to an OPENED position opening the walkway passage. The gate lock is carried on the gate to move with the gate as the gate is pivoted about the gate-pivot axis. The gate lock is configured to include a slidable latch that is arranged to engage a latch receiver provided in the gate mount to lock the gate in the CLOSED position.

In illustrative embodiments, the gate unit further includes a gate-motion controller in accordance with the present disclosure. The gate-motion controller provides a cam system that is linked to the upper hinge of the U-shaped gate mount and that functions to (1) hold the gate in a predetermined OPENED position once it has been opened, (2) pivot the gate to the CLOSED position automatically once it has been moved by a user relative to the gate mount toward the CLOSED position to a TRANSITION position located between the OPENED and CLOSED positions, and (3) retain the gate in the CLOSED position until the gate is later opened by a user.

In illustrative embodiments, the upper hinge of the gate mount includes a stationary pivot support that is coupled to a first wall panel also included in the gate mount. The upper hinge also includes a movable pivot that is coupled to the gate to move therewith and is arranged to pivot on the stationary pivot support at the gate-pivot axis to enable pivoting movement of the gate about the gate-pivot axis between the OPENED and CLOSED positions.

In illustrative embodiments, the cam system of the gate-motion controller includes a stationary cam coupled to a topside of the stationary pivot support and a movable cam follower coupled to an underside of the movable pivot of the upper hinge that is mounted on the gate. The movable cam follower is arranged to extend downwardly to engage and ride on the stationary cam during pivoting movement of the gate between the OPENED and CLOSED positions.

In illustrative embodiments, the stationary cam comprises a negatively sloping gate-opener ramp, an upwardly opening follower-receiver notch, and a positively sloping gate-closer ramp extending between and interconnecting the negatively sloping gate-opener ramp and the follow-receiver notch. The cam follower extends into the follower-receiver notch when the gate is closed to retain the gate in the CLOSED position. The cam follower engages the negatively sloping gate-opener ramp when the gate is opened to retain the gate in the OPENED position. The cam follower engages and rides on the positively sloping gate-closer ramp to close the gate automatically once a user begins to pivot the gate from the OPENED position toward the CLOSED position.

In illustrative embodiments, there is a high-point peak provided at a junction between the negatively sloping gate-opener ramp and the positively sloping gate-closer ramp that functions to define the TRANSITION position of the gate. The downwardly extending cam follower that is coupled to the movable pivot mounted on the gate engages and rides on the upwardly facing stationary cam on the stationary pivot support mounted on the U-shaped gate mount during pivoting motion of the gate about the gate-pivot axis between the OPENED and CLOSED positions. The cam follower engages the positively sloping gate-closer ramp during the pivoting motion of the gate from the TRANSITION position to the CLOSED POSITION.

In illustrative embodiments, the gate is held in its OPENED position owing to engagement of the downwardly extending cam follower and the upwardly facing negatively sloping gate-opener ramp of the cam when the gate is in the OPENED position. Engagement of the cam follower and the gate-opener ramp of the cam is maintained by the weight of the gate in cooperation with a spring force generated by a pivot-load spring included in the gate mount and arranged to cause a downward force to be applied through the cam follower to the negatively sloping gate-opener ramp of the cam to retain the gate in the OPENED position.

To open the gate in accordance with illustrative embodiments of the present disclosure, a user must apply sufficient torque to the gate to cause the cam follower to ride up the negatively sloping gate-opener ramp of the cam, pass over the height-point peak at the TRANSITION position of the gate, and then slide downwardly on the positively sloping gate-closer ramp of the cam toward the follower-receiver notch. The weight of the gate and the spring force generated by the pivot-load spring cooperate to ensure that the cam follower slides downwardly along the positively sloping gate-opener ramp of the stationary cam into the follow-receiver notch once the gate has been pivoted by the user to the TRANSITION position during pivoting of the gate toward the CLOSED position. The gate will then be retained in the CLOSED position since the weight of the gate and the force generated by the pivot-load spring will continue to apply a downward force to the cam follower to ensure that the downwardly extending cam follower remains in the upwardly opening follower-receiver notch until enough gate-opening torque is applied by a user to the gate to move the cam follower upwardly along the positively sloping gate-closer ramp of the cam, over one of the highpoint peaks, and then downwardly along the negatively sloping gate-opener ramp of the stationary cam.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying Figs. in which.

DETAILED DESCRIPTION

Figure 1:
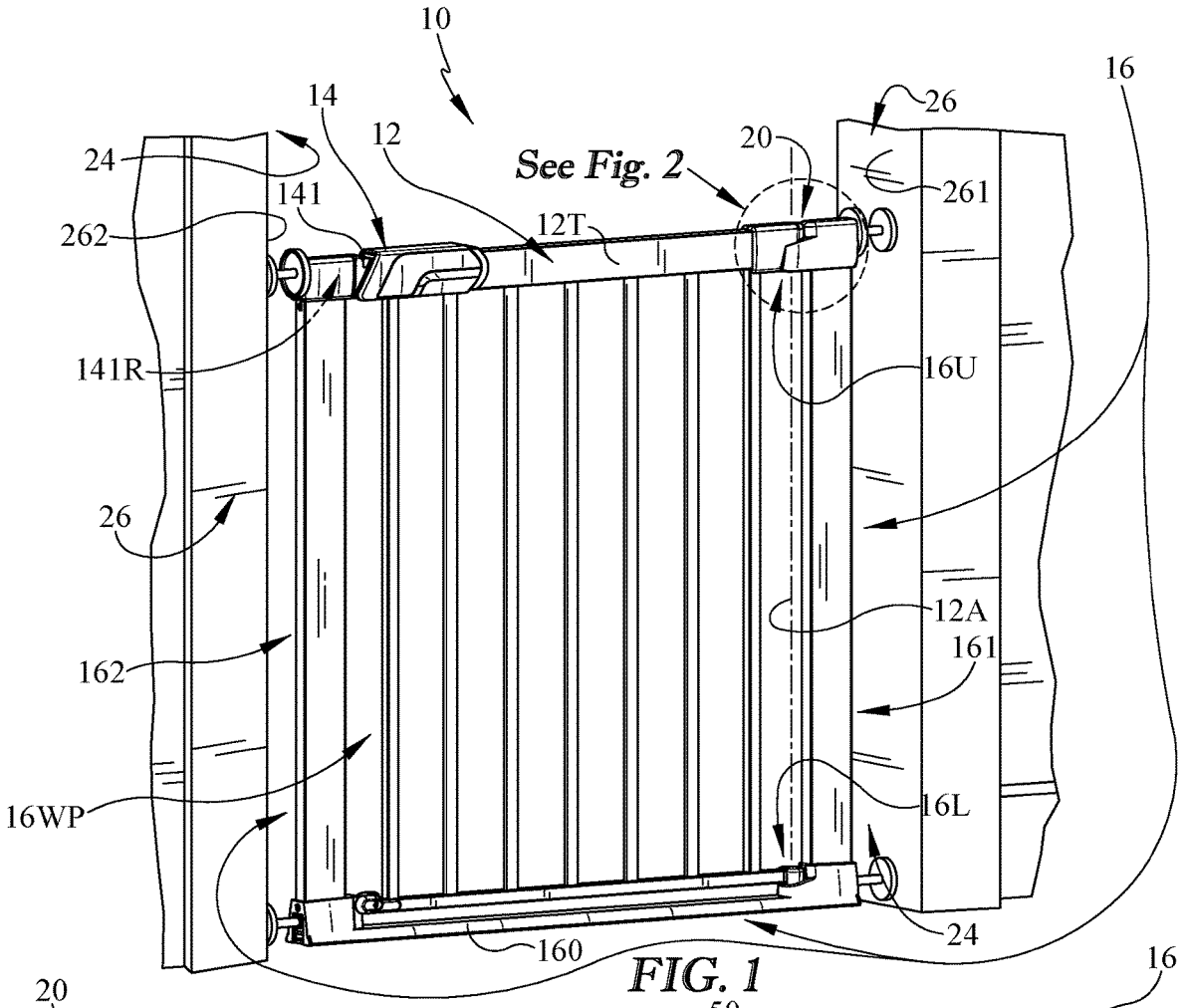
FIG. 1 is a front view of a gate unit in accordance with the present disclosure placed in a doorway and showing that the gate unit includes a U-shaped gate mount mating with a door frame bordering the doorway, a gate mounted on the gate mount for swinging movement about a vertical gate-pivot axis between CLOSED and OPENED positions, and a gate lock coupled to the gate and configured to mate with a left-side portion of the gate mount to retain the gate in the CLOSED position and suggesting that the gate unit also includes a gate-motion controller in accordance with the present disclosure that is shown in more detail in FIG. 11 and functions to (1) hold the gate in an OPENED position once it has been opened as suggested in FIG. 5, (2) urge the gate automatically to the CLOSED POSITION once it has been moved to past a TRANSITION position as suggested in FIG. 6, and (3) retain the gate in the CLOSED POSITION as suggested in FIG. 7.

A gate unit 10 in accordance with the present disclosure is shown in FIG. 1 and includes a gate 12 that can be moved about a gate-pivot axis 12A by a person between OPENED and CLOSED positions. In illustrative embodiments, gate unit 10 also includes a gate lock 14 that is movable relative to gate 12 to retain the gate in the CLOSED position and establish a locked mode of gate 12.

Figure 3:
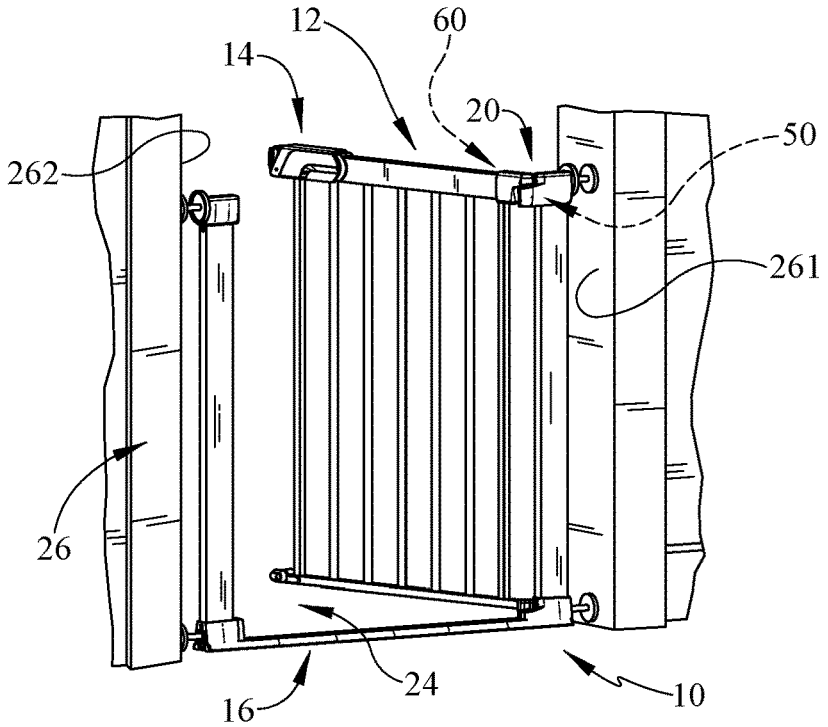
FIG. 3 is a reduced-size perspective view of the gate unit of FIG. 1 showing the gate as it is being moved away from a CLOSED position.

Gate unit 10 also includes a gate mount 16 that is adapted to mate with a door frame 26 bordering a doorway 24 as shown, for example, in FIGS. 1 and 3. It is also within the scope of the present disclosure to adapt gate mount 16 to mate with a frame bordering a passageway (e.g. opposing walls in a hallway).

Figure 5:
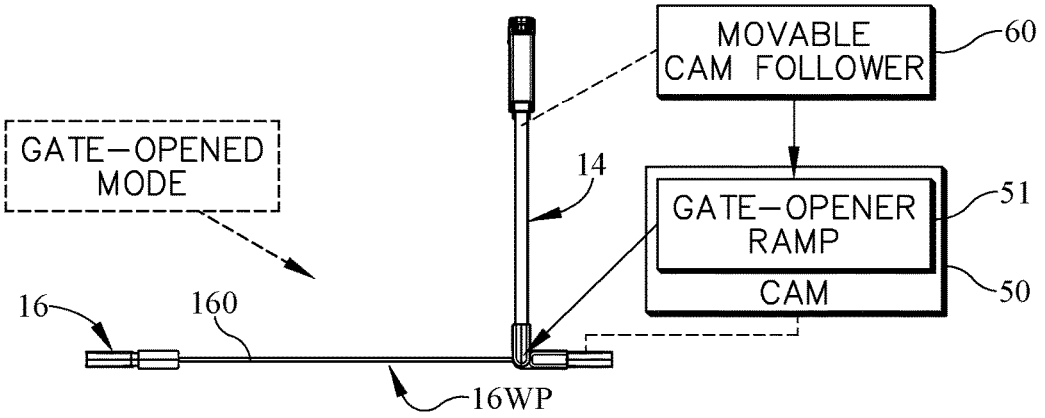
FIG. 5 is a view similar to FIG. 4 showing the gate in a gate-opened mode in which the movable cam follower engages the negatively sloping gate-opener ramp of the stationary cam to retain the gate in the OPENED position.
Figure 7:
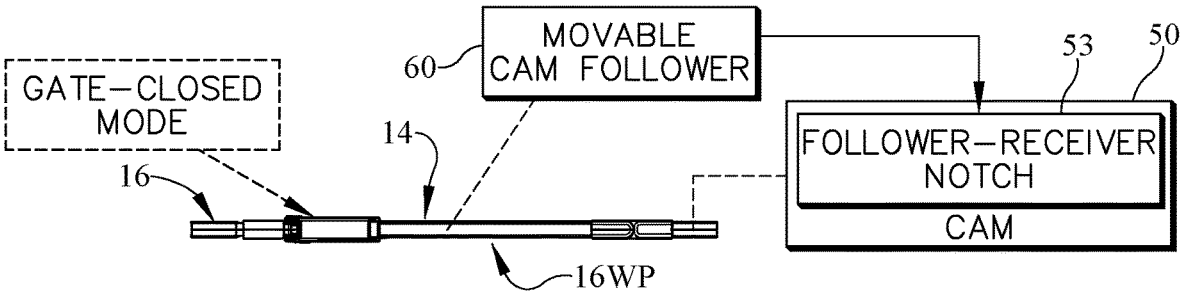
FIG. 7 is a view similar to FIGS. 4-6 showing the gate in a gate-closed mode in which the movable cam follower is engaged in the follower-receiver notch formed in the stationary cam to retain the gate in the CLOSED position.

Gate 12 is mounted on upper and lower hinges 16U, 16L included in gate mount 16 for pivotable movement about gate-pivot axis 12A as suggested in FIG. 1 between a CLOSED position closing a walkway passage 16WP formed in gate mount 16 to block movement of a person through the walkway passage 16WP as suggested in FIG. 7 to an OPENED position opening the walkway passage 16WP as suggested in FIG. 5. Gate lock 14 is carried on gate 12 to move with gate 12 as the gate 12 is pivoted about gate-pivot axis 12A. Gate lock 14 is configured to include a slidable latch 141 that is arranged to engage a latch receiver 141R provided in gate mount 16 to lock gate 12 in the CLOSED position as suggested in FIG. 1.

Figure 2:
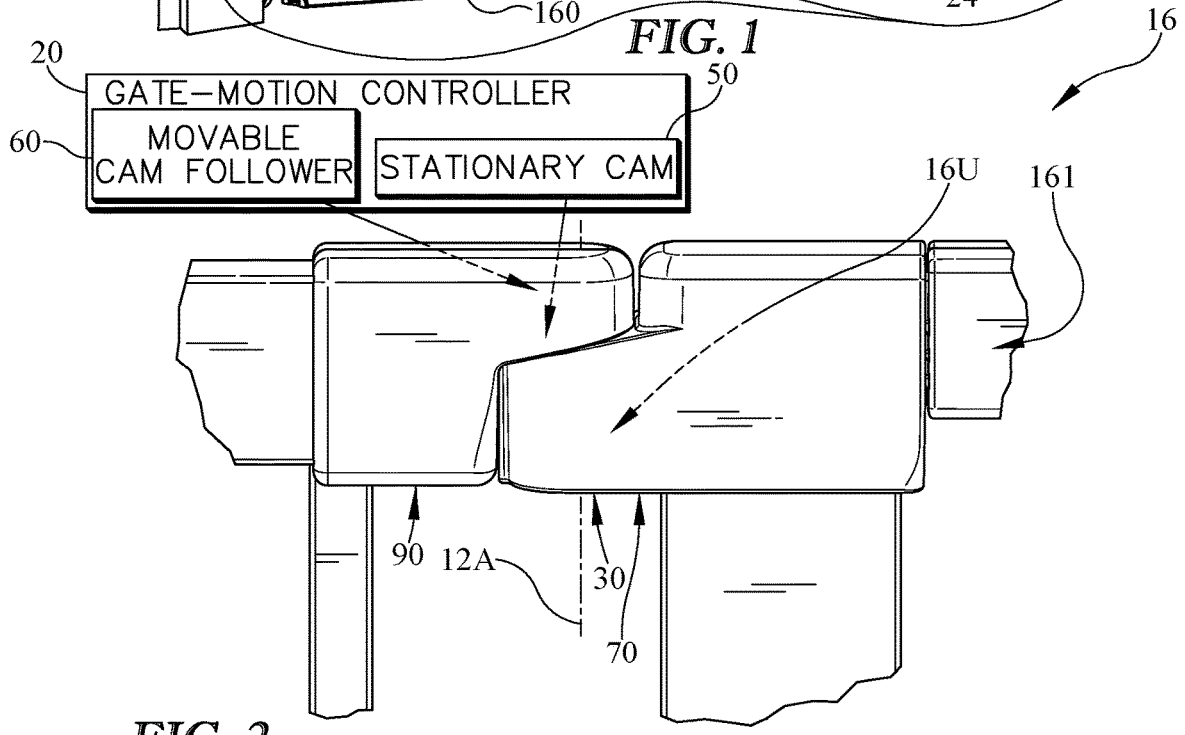
FIG. 2 is an enlarged view of the circled region in FIG. 1 suggesting that the gate mount includes a stationary first wall panel and an upper hinge that is coupled to the stationary first wall panel and the gate and is configured to support the gate for swinging movement about the vertical gate-pivot axis between the OPENED and CLOSED positions and suggesting that the gate-motion controller includes a stationary cam that is fixed in a stationary position on the gate mount as suggested in FIG. 11 and a movable cam follower that is mounted on the gate as suggested in FIG. 11 for pivotable movement with the gate as suggested in FIGS. 4-7 to engage and ride on the stationary cam during swinging movement of the gate.
Figure 10:
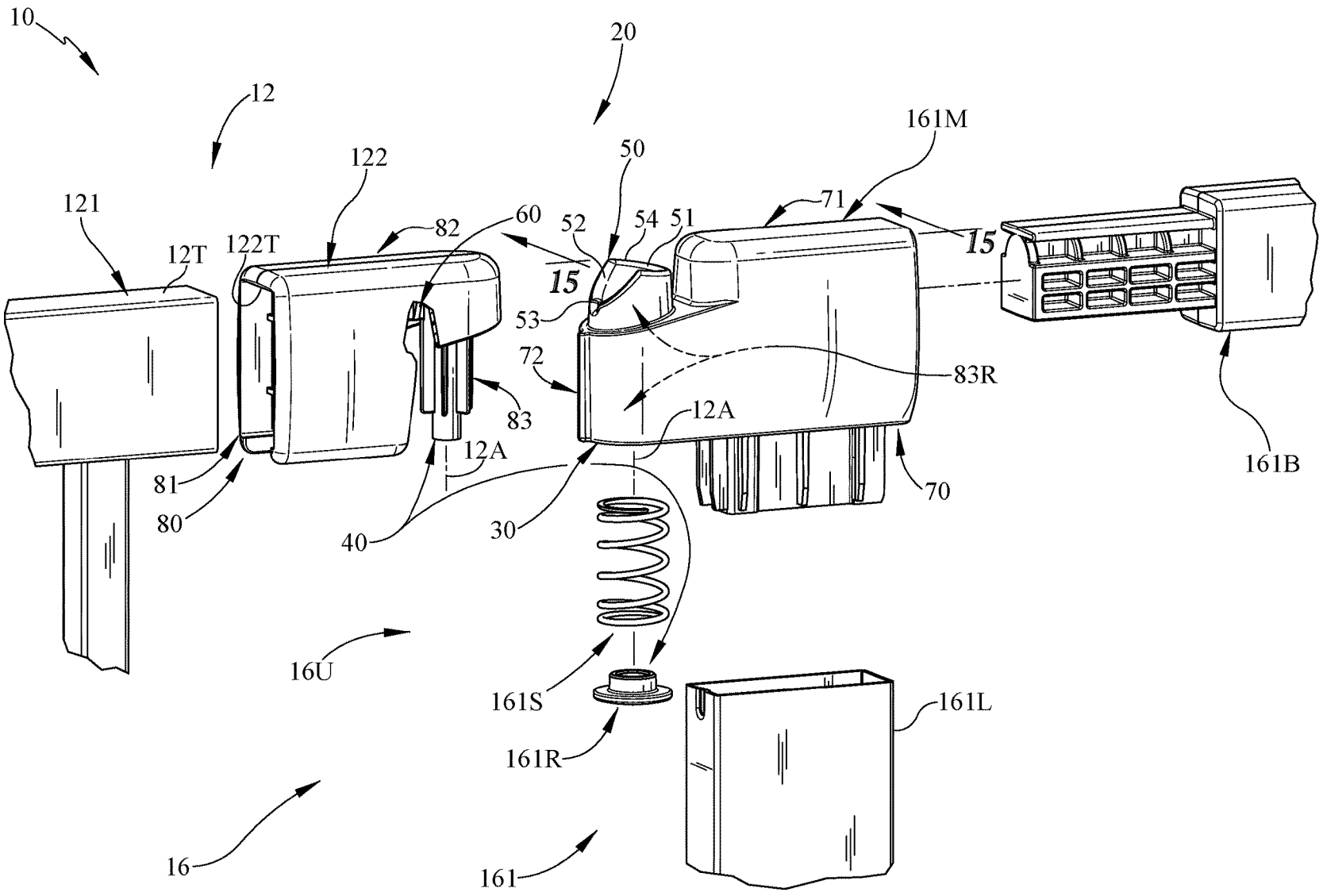
FIG. 10 is an exploded perspective assembly view that shows several of the components that are included in the gate unit and suggests that the gate mount includes a first wall panel including a vertical leg, a pivot-support mount coupled a top end of to the vertical leg, and a horizontal top beam coupled to the pivot-mount support, and suggests that the gate mount also includes an upper hinge comprising a stationary pivot support coupled to the pivot-support mount and a movable pivot coupled to the pivot mount of the gate and sized to engage and rotate in a pivot-receiver passageway formed in the stationary pivot support during rotation of the gate about the vertical gate-pivot axis, and further suggests that the gate-motion controller includes a movable cam follower coupled to the pivot mount of the gate and an underlying stationary cam coupled to the stationary pivot support of the gate mount.
Figure 11:
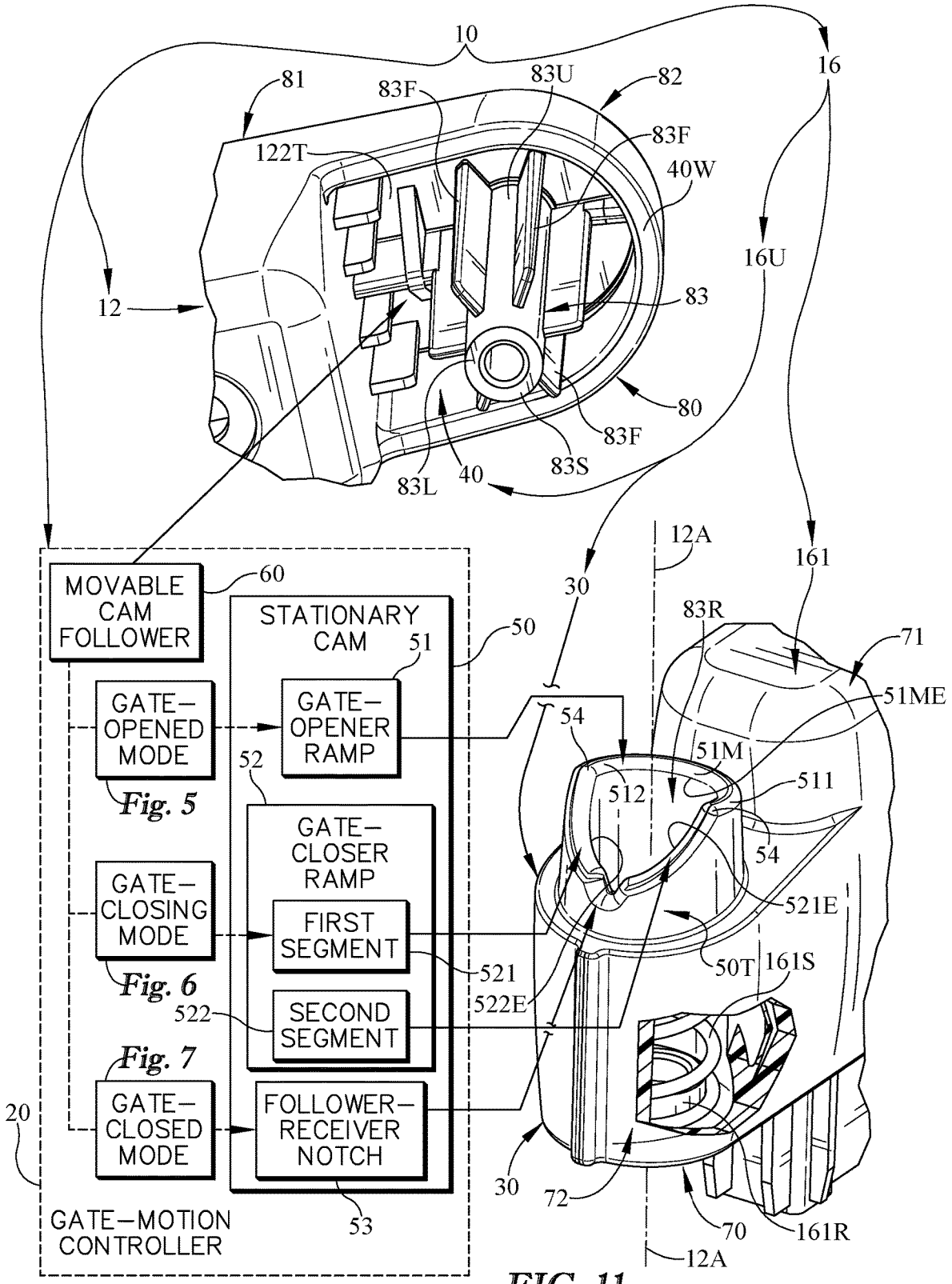
FIG. 11 is a diagrammatic view of the gate unit showing separation of the movable cam follower included in the gate-motion controller from the underlying stationary cam also included in the gate-motion controller and suggesting that the movable cam follower engages: (1) the gate-opener ramp of the stationary cam in the gate-opened mode of the gate, (2) a first segment of the gate-closer ramp during counterclockwise movement of the gate about the vertical gate-pivot axis as suggested in FIG. 6 in a gate-closing mode of the gate, and (3) a follower-receiver notch formed in the stationary cam in the gate-closed mode of the gate.

Gate unit 10 further includes a gate-motion controller 20 in accordance with the present disclosure as suggested in FIGS. 1, 2, and 11. Gate-motion controller 20 provides a cam system that is linked to upper hinge 16U of gate mount 16 and that functions to (1) hold gate 12 in an OPENED position automatically once it has been opened as suggested in FIG. 5, (2) pivot gate 12 to the CLOSED position once it has been moved relative to gate mount 16 toward the CLOSED position to a TRANSITION position as suggested in FIG. 6, and (3) retain gate 12 in the CLOSED position as suggested in FIG. 7. Upper hinge 16U of gate mount 16 includes a stationary pivot support 30 that is coupled to a first wall panel 161 also included in gate mount 16 as suggested in FIGS. 10 and 11. Upper hinge 16U also includes a movable pivot 40 that is coupled to gate 12 to move therewith and is arranged to pivot on stationary pivot support 30 at gate-pivot axis 12A to enable pivoting movement of gate 12 about gate-pivot axis 12A between the OPENED and CLOSED positions as suggested in FIGS. 10 and 11.

As suggested in FIGS. 4-7 and 11, the cam system of gate-motion controller 20 includes a multi-ramp stationary cam 50 coupled to stationary pivot support 30 and a movable cam follower 60 coupled to an underside of the movable pivot 40 that is mounted on gate 12. Movable cam follower 60 is arranged to extend downwardly to engage and ride on the ramps 51, 52 included stationary cam 50 during pivoting movement of gate 12 between the OPENED and CLOSED positions and to extend into follower-receiver notch 53 formed in stationary cam 50 when gate 12 is closed.

Stationary cam 50 comprises a negatively sloping gate-opener ramp 51, an upwardly opening follower-receiver notch 53, and a positively sloping gate-closer ramp 52 comprising separate first and second segments 521, 522 extending between and interconnecting the negatively sloping gate-opener ramp 51 and upwardly opening follow-receiver notch 53 as shown for example, in FIG. 11. There is a high-point peak 54 provided at a junction between negatively sloping gate-opener ramp 51 and each segment 521, 522 of positively sloping gate-closer ramp 51.

Figure 4:
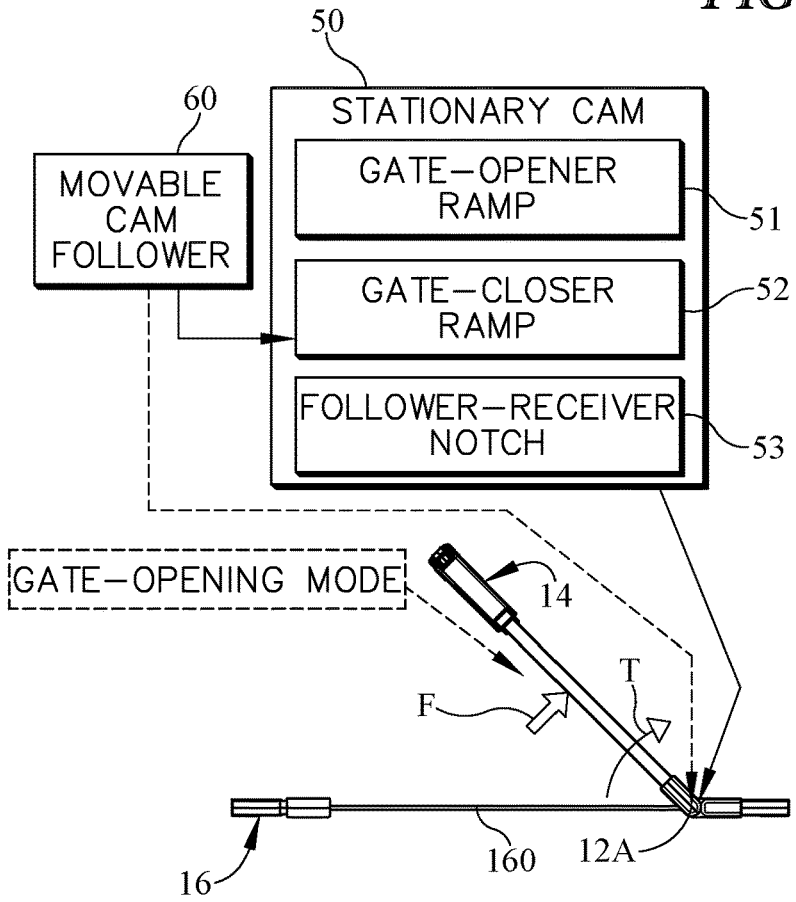
FIG. 4 is a diagrammatic top plan view of the gate unit of FIG. 3 showing the gate in a gate-opening mode and suggesting that a user has applied a gate-opener force to pivot the gate in a clockwise direction to cause the movable cam follower to engage and move upwardly on the positively sloping gate-closer ramp of the stationary cam.
Figure 6:
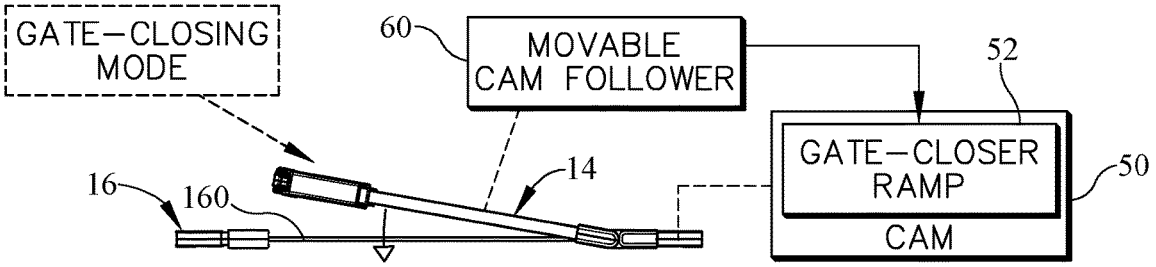
FIG. 6 is a view similar to FIGS. 4 and 5 showing the gate in a gate-closing mode in which the movable cam follower engages and moves downwardly on the positively sloping gate-closer ramp to cause the gate to move automatically in a counterclockwise direction to the CLOSED position shown in FIG. 7.

Movable cam follower 60 is coupled to the movable pivot 40 mounted on gate 12 and engages and rides on the ramps 51, 52 included in stationary cam 50 on the stationary pivot support 30 mounted on the U-shaped gate mount 16 during pivoting motion of gate 12 about gate-pivot axis 12A between the OPENED and CLOSED positions as suggested in FIGS. 4, 6, and 11. Movable cam follower 60 extends into the upwardly opening follower-receiver notch 53 formed in stationary cam 50 when gate 12 is closed to block rotation of movable pivot 40 on stationary pivot support 30 about gate-pivot axis 12A as suggested in FIG. 7. Movable cam follower 60 engages negatively sloping gate-opener ramp 51 of stationary cam 50 when gate 12 is opened to tend to retain gate 12 in a predetermined OPENED position as suggested in FIG. 5. Movable cam follower 60 engages and rides downhill under gravity and under a downward force generated by a pivot-load spring 161S included in gate mount 16 on positively sloping gate-closer ramp 52 of stationary cam 50 during the pivoting motion of gate 12 from the OPENED position to the CLOSED POSITION as suggested in FIG. 6.

Gate 12 is held in its OPENED position owing to engagement of the downwardly extending movable cam follower 60 and the upwardly facing negatively sloping gate-opener ramp 51 of stationary cam 50 when gate 12 is in the OPENED position as suggested diagrammatically in FIG. 5. Engagement of movable cam follower 60 and gate-opener ramp 51 of stationary cam 50 is maintained by the weight of gate 12 that generates a downward gravity force $F_G$ and the downward force $F_S$ generated by pivot-load spring 161S. This downward spring force $F_S$ is applied to retainer 161R and transferred to fin-support rod 83S of mount pin 83 of movable pivot 40 to cause a downward force $F_D$ to be applied through movable cam follower 60 to the negatively sloping gate-opener ramp 51 of stationary cam 50 to retain gate 12 in the OPENED position as suggested in FIG. 16.

To open gate 12, a user must apply a gate-opener force (F) to apply sufficient torque (T) to gate 12 as suggested in FIG. 4. The applied torque (T) will pivot gate 12 about gate-pivot axis 12A to cause movable cam follower 60 to ride up the negatively sloping gate-opener ramp 51 of stationary cam 50, pass over one of the high-point peaks 54 associated with the TRANSITION position of gate 12, and then slide downwardly on the positively sloping gate-closer ramp 52 of stationary cam 50 toward the upwardly opening follower-receiver notch 53. The weight of gate 12 and down-force $F_S$ generated by pivot-load spring 161S applies a transferred downward force $F_D$ to movable cam follower 60 to ensure that movable cam follower 60 slides downwardly along the positively sloping gate-opener ramp 52 of stationary cam into the upwardly opening follow-receiver notch 53 when gate 12 has been pivoted by the user to and past the TRANSITION position as suggested in FIG. 5.

Gate 12 will then be retained in the CLOSED position since the weight of gate 12 and the transferred downward force $F_S$ generated by pivot-load spring 161S will continue to apply a downward force $F_D$ to movable cam follower 60 to ensure that the downwardly extending movable cam movable follower 60 remains in the upwardly opening follower-receiver notch 53 formed in stationary cam 50 as suggested in FIG. 7. Movable cam follower 60 will remain in the upwardly opening follower-receiver notch 53 until enough gate-opening torque (T) is applied by a user to gate 12 to move cam follower 60 upwardly along the positively sloping gate-closer ramp 52 of stationary cam 50, over one of the highpoint peaks 54, and then downwardly along the negatively sloping gate-opener ramp 51 of stationary cam 50.

Gate mount 16 lies in a doorway 24 and mates with first and second doorjambs 261, 262 included in a doorframe 26 bordering doorway 24 as suggested in FIG. 1. Gate mount 16 is substantially U-shaped in an illustrative embodiment and is formed to include a walking passage 16WP through which people are able to walk when gate 12 is opened.

Gate unit 10 includes gate 12, gate mount 16, and gate-motion controller 20 as suggested in FIGS. 1, 10, and 11. Gate mount 16 is adapted to mate with a frame 26 bordering a passageway 24 as shown, for example, in FIGS. 1 and 3.

Gate mount 16 includes an upper (gate) hinge 16U as suggested in FIG. 1. Gate mount 16 includes a stationary pivot support 30 and a movable pivot 40 that is mated in rotative bearing engagement with stationary pivot support 30 to establish a gate-pivot axis 12A as suggested in FIGS. 10 and 11.

Gate 12 is coupled to movable pivot 40 of gate hinge 16U for pivotable movement with movable pivot 40 about gate-pivot axis 12A as suggested in FIGS. 10 and 11. Gate 12 can be pivoted between a CLOSED position closing a walkway passage 16WP formed in gate mount 16 to block movement of a person through the walkway passage 16WP as suggested in FIGS. 1 and 7 and an OPENED position opening walkway passage 16WP to allow movement of a person through walkway passage 16WP as suggested in FIG. 5.

Gate-motion controller 20 includes a stationary cam 50 coupled to stationary pivot support 30 and a cam follower 60 coupled to gate 12 to pivot therewith about gate-pivot axis 12A. Cam follower 60 is arranged to extend downwardly to engage and ride on stationary cam 50 during pivoting movement of gate 12 about gate-pivot axis 12A between the OPENED and CLOSED positions as suggested in FIGS. 8-11.

Stationary cam 50 includes a negatively sloping gate-opener ramp means 51 as shown in FIG. 11 for engaging cam follower 60 to retain gate 12 in a FIRST OPENED position as suggested in FIG. 5 in response to pivoting movement of gate 12 about gate-pivot axis 12A from the CLOSED position through an angle of about 90 degrees in a clockwise direction and to retain gate 12 in a SECOND OPENED position (i.e. 180° opposite to the position shown in FIG. 5) in response to pivoting movement of gate 12 about gate-pivot axis 12A from the CLOSED position through an angle of about 90 degrees in a counterclockwise direction. Stationary cam 50 also includes follower-receiver notch means 53 as shown in FIG. 11 for receiving cam follower 60 upon arrival of gate 12 at the CLOSED position to retain gate 12 temporarily in the CLOSED position as suggested in FIG. 7.

Stationary cam 50 further includes a gate-closer ramp 52 as shown in FIG. 11 including a positively sloping first segment 521 interconnecting the follow-receiver notch means 53 and the negatively sloping gate-opener ramp means 51 and engaging cam follower 60 during pivoting motion of gate 12 in the clockwise direction from the CLOSED position to the FIRST OPENED position as suggested in FIG. 4. Stationary cam 50 also includes a positively sloping second segment 522 interconnecting the follower-receiver notch means 53 and the negatively sloping gate-opener ramp means 51 and engaging cam follower 60 during pivoting motion of gate 12 in the counterclockwise direction from the CLOSED position to the SECOND OPENED position.

The negatively sloping gate-opener ramp means 51 comprises an inclined U-shaped surface that is shown in FIG. 11 and includes a high-elevation first end 511 coupled to the positively sloping first segment 521 of gate-closer ramp 52, a high-elevation second end 512 coupled to positively sloping second segment 522 of the gate-closer ramp 52, and a relatively lower low-elevation mid-section 51M located midway between the high-elevation first and second ends 511, 512. Each of the positively sloping first and second segments 521, 522 is curved and includes a concave inner edge 521E, 522E arranged to face toward gate-pivot axis 12. Mid-section 5IM is also carved and includes concave inner edge 5IME. The follower-receiver notch means 53 and the relatively lower low-elevation mid-section 51M of the inclined U-shaped surface are diametrically opposed to one another along a reference line arranged to extend through gate-pivot axis 12A.

Figure 13:
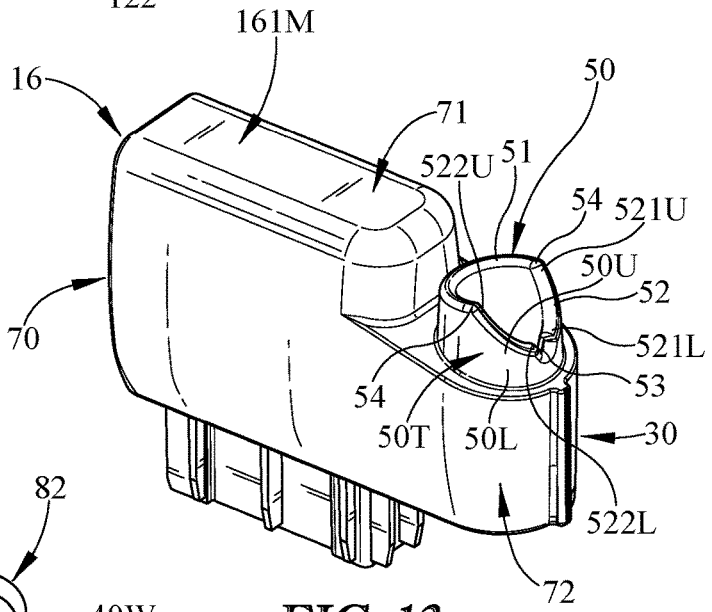
FIG. 13 is an upright perspective view of a gate-mount bracket that is associated with a first wall panel of the gate mount as suggested in FIG. 10 and is a monolithic component comprising the pivot-support mount of the gate mount, the stationary pivot support of the upper hinge of the gate mount, and the stationary cam of the gate-motion controller and that suggests that the gate-opener and gate-closer ramps included in the stationary cam provide a bearing surface to be engaged by the movable cam follower during pivoting motion of the gate about the vertical gate-pivot axis.
Figure 14:
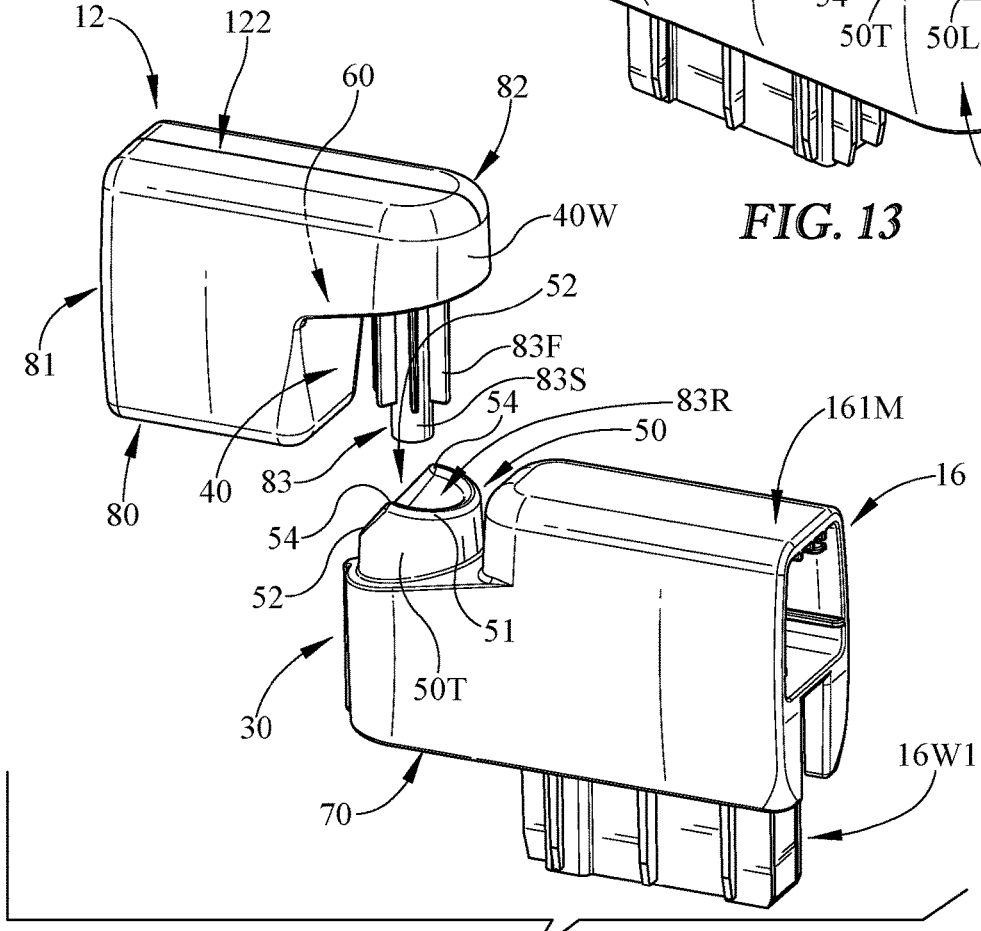
FIG. 14 is a perspective assembly view showing the gate-panel bracket (on the left) before it is mated with the gate-mount bracket (on the right) and showing that the stationary cam includes a gate-opener ramp, a gate-closer ramp, and a high-point peak between those two ramps.

Stationary cam 50 is a tube 50T formed to include a lower tube end 50L coupled to stationary pivot support and upper tube end 50U arranged to face toward cam follower 60 as shown in FIGS. 11 and 13. Upper tube end 50U is formed to include the follower-receiver notch means 53, gate-closer ramp 52, and the negatively sloping gate-opener ramp means 51. The tube 50T provided by stationary cam 50 is also formed to include a central pin-receiving passageway 83R extending along gate-pivot axis 12A from upper tube end 50U to lower tube end 50L. The movable pivot 40 of gate hinge 16U includes a mount pin 83 that is arranged to extend along gate-pivot axis 12A in a downward direction into central pin-receiving passageway 83R. Mount pin 83 is coupled to gate 12 to rotate about gate-pivot axis 12A during pivotable movement of gate 12 about gate-pivot axis 12A.

Gate 12 includes a swinging panel 121 and a pivot mount 122 coupled to the swinging panel 121 as suggested in FIG. 10. Mount pin 83 of movable pivot 40 of gate hinge 16U includes an upper pin end 83U coupled to pivot mount 122 and a lower pin end 83L arranged to extend into the central pin-receiving passageway 83R formed in tube 50T of stationary cam 50 as suggested in FIG. 11.

Stationary cam 50 comprises a negatively sloping gate-opener ramp 51 and a positively sloping gate-closer ramp 52 as shown in FIGS. 9, 11, 13, and 14. Cam follower 60 engages and rides on the positively sloping gate-closer ramp 52 during pivotable movement of gate 12 about gate-pivot axis 12A from the CLOSED position toward the OPENED position. Cam follower 60 engages the negatively sloping gate-opener ramp 51 upon pivotable movement of gate 12 to the OPENED position to retain gate 12 in a predetermined OPENED position. The positively sloping gate-closer ramp 52 includes a first segment 521 coupled to a first end of the negatively sloping gate-opener ramp 51 and a second segment 522 coupled to an opposite second end of the negatively sloping gate-opener ramp 51.

Cam follower 60 engages and rides on first segment 521 of the positively sloping gate-closer ramp 52 during clockwise movement of gate 12 about gate-pivot axis 12A from the CLOSED position to a FIRST OPENED position. Cam follower 60 engages and rides on second segment 522 of the positively sloping gate-closer ramp 52 during counterclockwise movement of gate 12 about gate-pivot axis 12A from the CLOSED position to a SECOND OPENED position. Cam follower 60 engages and rides on the negatively sloping gate-opener ramp 51 during counterclockwise movement of gate 12 about gate-pivot axis 12A from the FIRST OPENED positon to the CLOSED position and during clockwise movement of gate 12 about gate-pivot axis 12A from the SECOND OPENED position to the CLOSED position. The stationary cam 50 is formed to include follower-receiver notch means 53 located between first and second segments 521, 522 for receiving cam follower 60 therein upon arrival of gate 12 at the CLOSED position so that gate 12 is retained in the CLOSED position.

Each of the first and second segments 521, 522 and the negatively sloping gate-opener ramp 51 is curved as suggested in FIG. 11. Each of the first segment 521, the second segment 522, and the negatively sloping gate-opener ramp 51 includes a concave inner surface (521E, 522E, or 51ME) arranged to face toward gate-pivot axis 12A.

Each of the first and second segments 521, 522 has a low-elevation end 521L, 522L and a relatively higher high-elevation end 521U, 522U as shown in FIGS. 11 and 13. The high-elevation end of first segment 521 is coupled to first end 511 of the negatively sloping gate-opener ramp 51. The high-elevation end 522U of second segment 522 is coupled to the opposite second end 512 of the negatively sloping gate-opener ramp 51 to locate gate-pivot axis 12A midway between the high-elevation ends 521U, 522U of first and second segments 521, 522. The low-elevation ends 521L, 522L of first and second segments 521, 522 are arranged to lie in spaced-apart relation and close proximity to one another to form follower-receiver notch means 53 therebetween for receiving cam follower 60 therein upon arrival of gate 12 at the CLOSED position so that gate 12 is retained in the CLOSED position. Each of the first and second segments 521, 522 is curved. The negatively sloping gate-opener ramp 51 is also curved.

Figure 8:
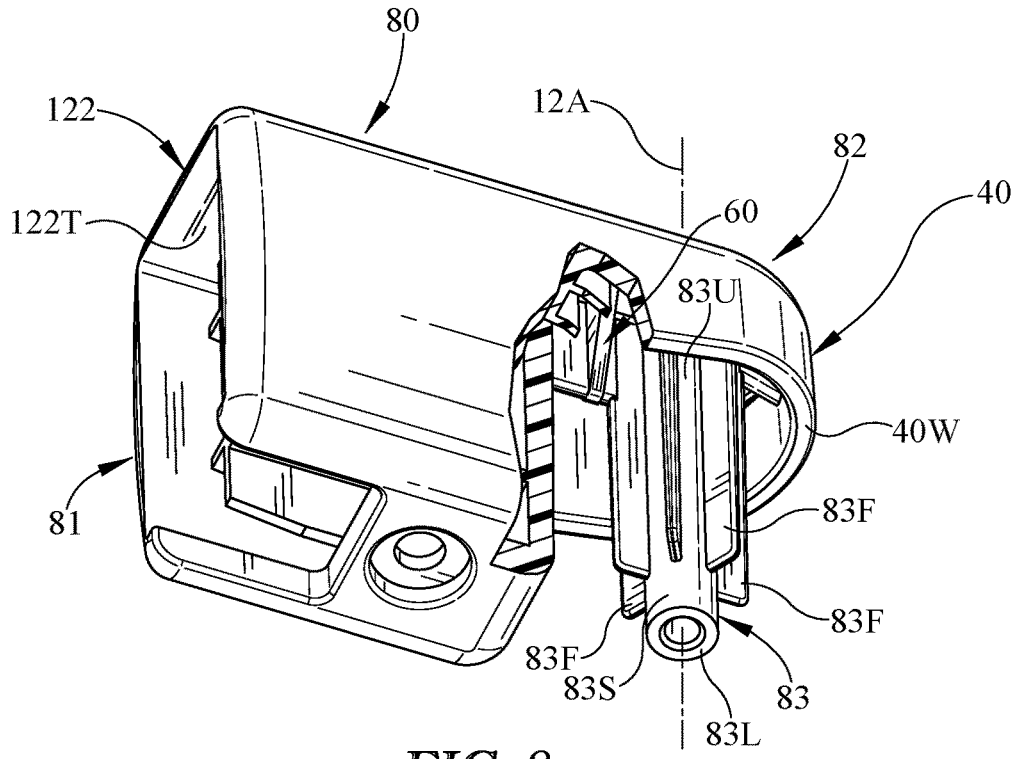
FIG. 8 is an enlarged perspective view of a movable pivot that is included in the upper hinge of the gate mount and is configured to be mated to the gate for pivoting motion with the gate about the vertical gate-pivot axis as suggested in FIGS. 1 and 5 and suggesting that the cam follower is coupled to the movable pivot for movement therewith about the vertical gate-pivot axis and is arranged to extend downwardly.
Figure 9:
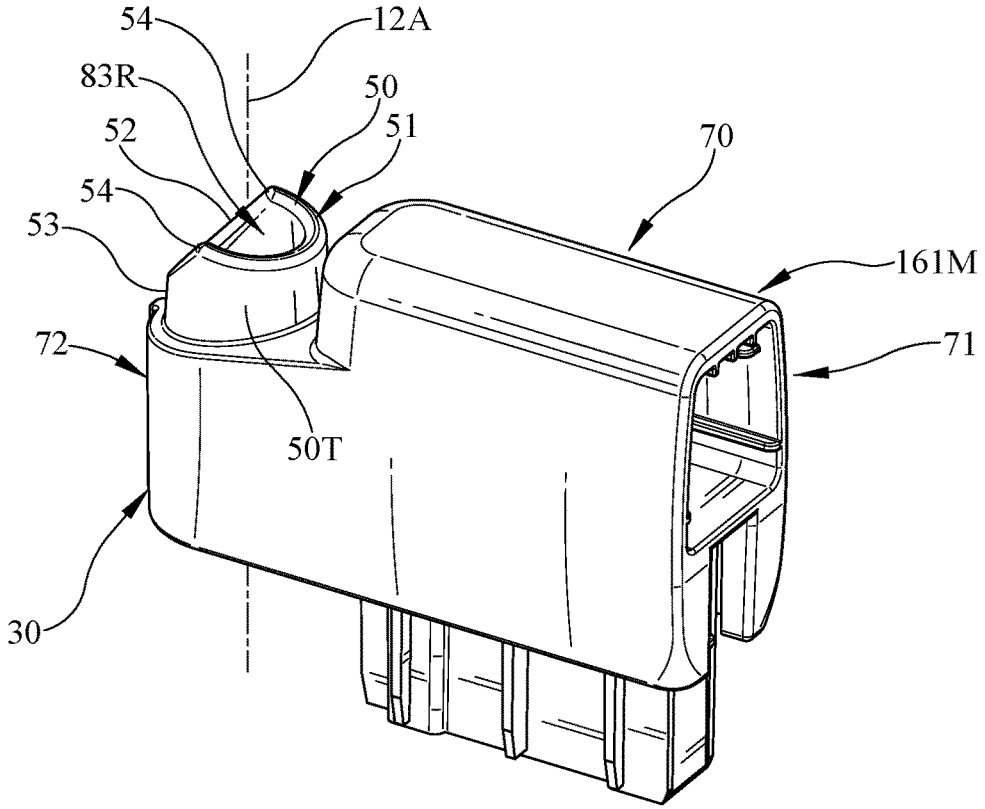
FIG. 9 is an enlarged perspective view of the stationary pivot support that is included in the upper hinge of the gate mount and that is arranged to mate with and support the movable pivot and suggesting that the stationary cam is formed on an upper tube end of an upstanding tube that is included in the stationary pivot support and is arranged to face upwardly.
Figure 12:
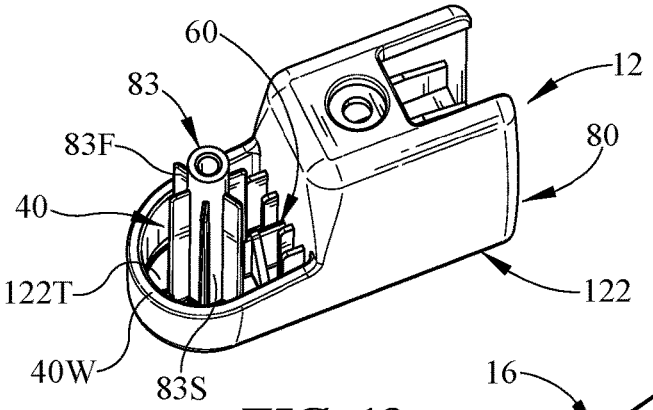
FIG. 12 is an inverted perspective view of a gate-panel bracket that is associated with a swinging panel included in the gate as suggested in FIG. 5 and is a monolithic component comprising the pivot mount of the gate, the movable pivot of the upper hinge of the gate mount, and the movable cam follower of the gate-motion controller and that suggests that the movable cam follower provides a riding surface that engages the underlying stationary cam included in the gate-motion controller.

Mount pin 83 of movable pivot 40 of gate hinge 16U includes an elongated fin-support rod 83S and several fins 83F cantilevered to a cylinder-shaped exterior surface of elongated fin-support rod 83S as shown in FIGS. 8, 11, and 12. Fins 83F are arranged to extend radially outwardly away from the cylinder-shaped exterior surface of elongated fin-support rod 83S and gate-pivot axis 12A to mate in rotative bearing engagement with a cylinder-shaped inner surface formed in stationary cam 50 to provide a boundary of pin-receiving passageway 83R formed in stationary cam 50. Retainer 161R is coupled to the lower end 83L of fin-support rod 83S as suggested in FIGS. 15 and 16.

The movable pivot 40 further includes a curved pin-surround wall 40W shown in FIGS. 8, 11, and 12 and coupled to pivot mount 122 of gate 12 and centered on 40 gate-pivot axis 12A partly to surround upper pin end 83U of mount pin 83 as suggested in FIG. 2. The curved pin-surround wall 40W includes a concave inner surface arranged to face toward upper pin end 83U of mount pin 83 and mate generally in rotative bearing engagement with a curved exterior surface of stationary cam 50 during pivoting movement of gate 12 about gate-pivot axis 12A between the OPENED and CLOSED positions.

Pivot mount 122 of gate 12 includes a horizontally extending top wall 122T as shown in FIG. 11. Upper pin end 83U of mount pin 83 is coupled to an underside of the horizontally extending top wall 122T to lie in laterally spaced-apart relation to gate 12. Cam follower 60 is coupled to the underside 122U of the horizontally extending top wall 122T and is arranged to lie between gate 12 and mount pin 83 and to extend downwardly away from the horizontally extending top wall 122T to engage each of the negatively sloping gate-opener ramp 51 and the positively sloping gate-closer ramp 52 during pivoting movement of gate 12 about gate-pivot axis 12 between the OPENED and CLOSED positions.

Stationary cam 50 further includes a high-point peak 54 as shown in FIG. 11 and provided at each junction between the negatively sloping gate-opener ramp 51 and the positively sloping gate-closer ramp 52 and associated with a TRANSITION position of gate 12 between the OPENED and CLOSED positions. Cam follower 60 engages the negatively sloping gate-opener ramp 51 when gate 12 occupies the OPENED position to tend to retain gate 12 in the OPENED position. Cam follower 60 is arranged to ride up the negatively sloping gate-opener ramp 51, pass over one of the two high-point peaks 54 associated with the TRANSITION position of gate 12, and then slide downwardly on the positively sloping gate-closer ramp 52 during rotation of gate 12 about gate-pivot axis 12A from the OPENED position to the CLOSED position.

Stationary cam 50 is formed to include a follower-receiver notch 53 associated with the CLOSED position of gate 12 as shown in FIG. 11. The positively sloping gate-closer ramp 52 is arranged to extend upwardly from follower-receiver notch 53 to the high-point peaks 54 associated with the TRANSITION position of gate 12. Cam follower 60 is arranged to slide downwardly on the positively sloping gate-closer ramp 52 during rotation of gate 12 about gate-pivot axis 12A from the OPENED position to the CLOSED position and extend into follower-receiver notch 53 upon arrival of gate 12 at the CLOSED position.

Gate mount 16 includes a flat foundation rail 160 arranged to extend along the floor underlying gate unit 10 and first and second wall panels 161, 162 as shown, for example, in FIG. 1. First wall panel 161 is arranged to extend upwardly from a first end of foundation rail 160 and to lie between gate 12 and first doorjamb 261. Second wall panel 162 is arranged to extend-upwardly from an opposite second end of foundation rail 160 and lie between second doorjamb 262 and gate 12.

First wall panel 161 includes a horizontal top beam 161B, a vertical leg 161L, and a pivot-support mount 161M as shown, for example, in FIG. 5. Pivot-support mount 161 is coupled to a top end of vertical leg 161L and a left end of horizontal top beam 161B as suggested in FIGS. 1 and 10.

A gate-mount bracket 70 is associated with first wall panel 161 of gate mount 16 as suggested in FIG. 5 and is shown also in FIGS. 2, 9, 13, and 14. Gate-mount bracket 70 is a monolithic component made of a plastics material. Gate-mount bracket 70 comprises a pivot-support mount 161M of gate mount 16, stationary pivot support 30 of upper hinge 16U of gate mount 16, and stationary cam 50 of gate-motion controller 20.

A gate-panel bracket 80 is associated with a swinging panel 121 of gate 12 as suggested in FIGS. 1 and 10. Gate-panel bracket 80 is a monolithic component made of a plastics material. Gate-panel bracket 80 comprises a pivot mount 122 of gate 12, the movable pivot 40 of upper hinge 160 of gate mount 16, and movable cam follower 60 of gate-motion controller 20.

A gate-motion controller 20 in accordance with the present disclosure is configured to urge gate 12 to close and engage gate mount 16 as shown in FIG. 1. A movable pivot 40 is coupled to gate 12 for pivotable movement therewith about gate-pivot axis 12A and a stationary pivot support 30 is coupled to gate mount 16.

Gate 12 includes a swinging panel 121 that carries gate lock 14 and a pivot mount 122 that is coupled to gate-motion controller 20 as suggested in FIGS. 1 and 10. Pivot mount 122 and cam follower 60 cooperate to form a gate-panel bracket 80 as shown in FIG. 10.

Figure 15:
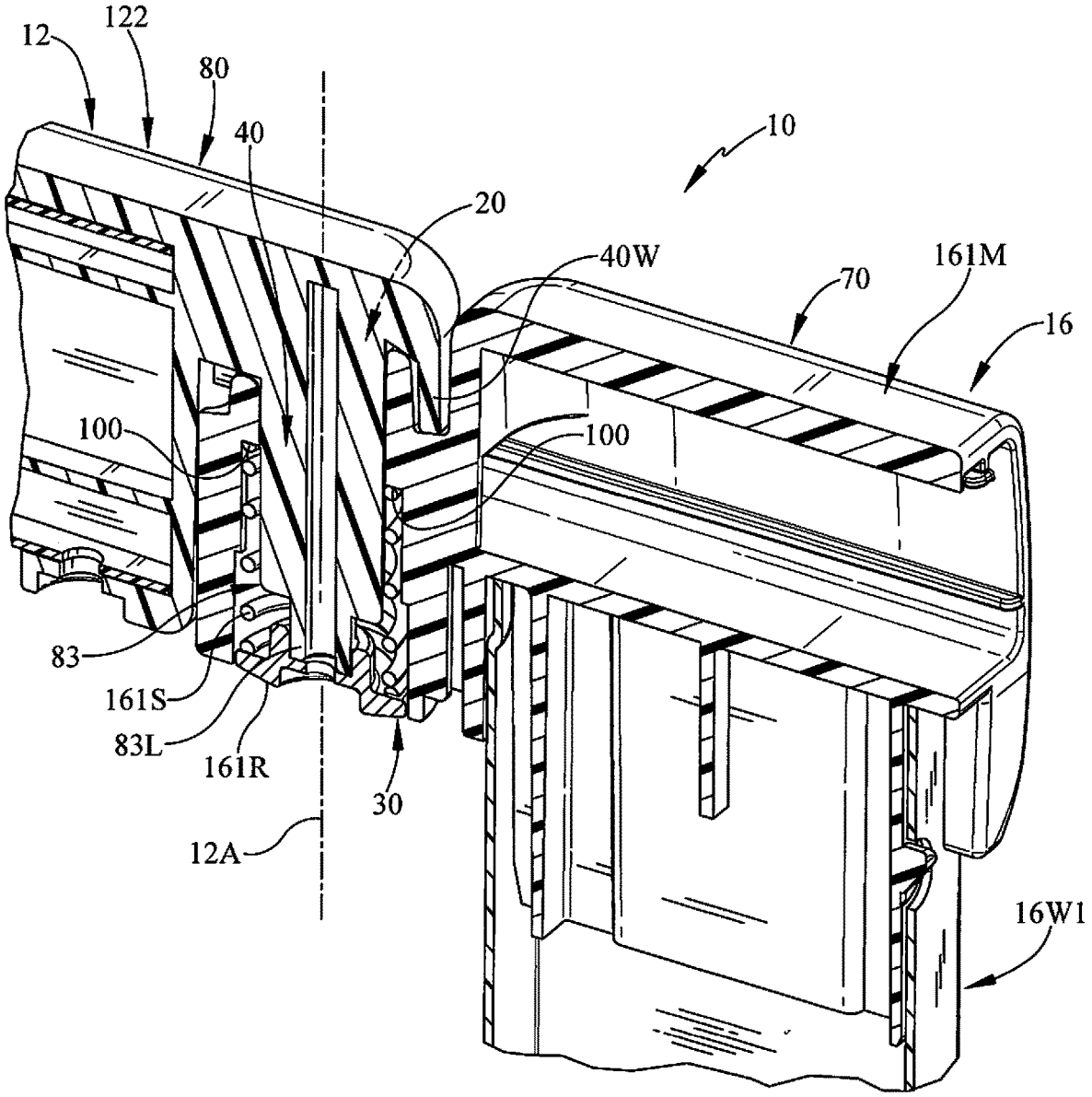
FIG. 15 is a reduced-size sectional view taken along line 15-15 of FIG. 1-10 after assembly of the components shown in FIG. 10.
Figure 16:
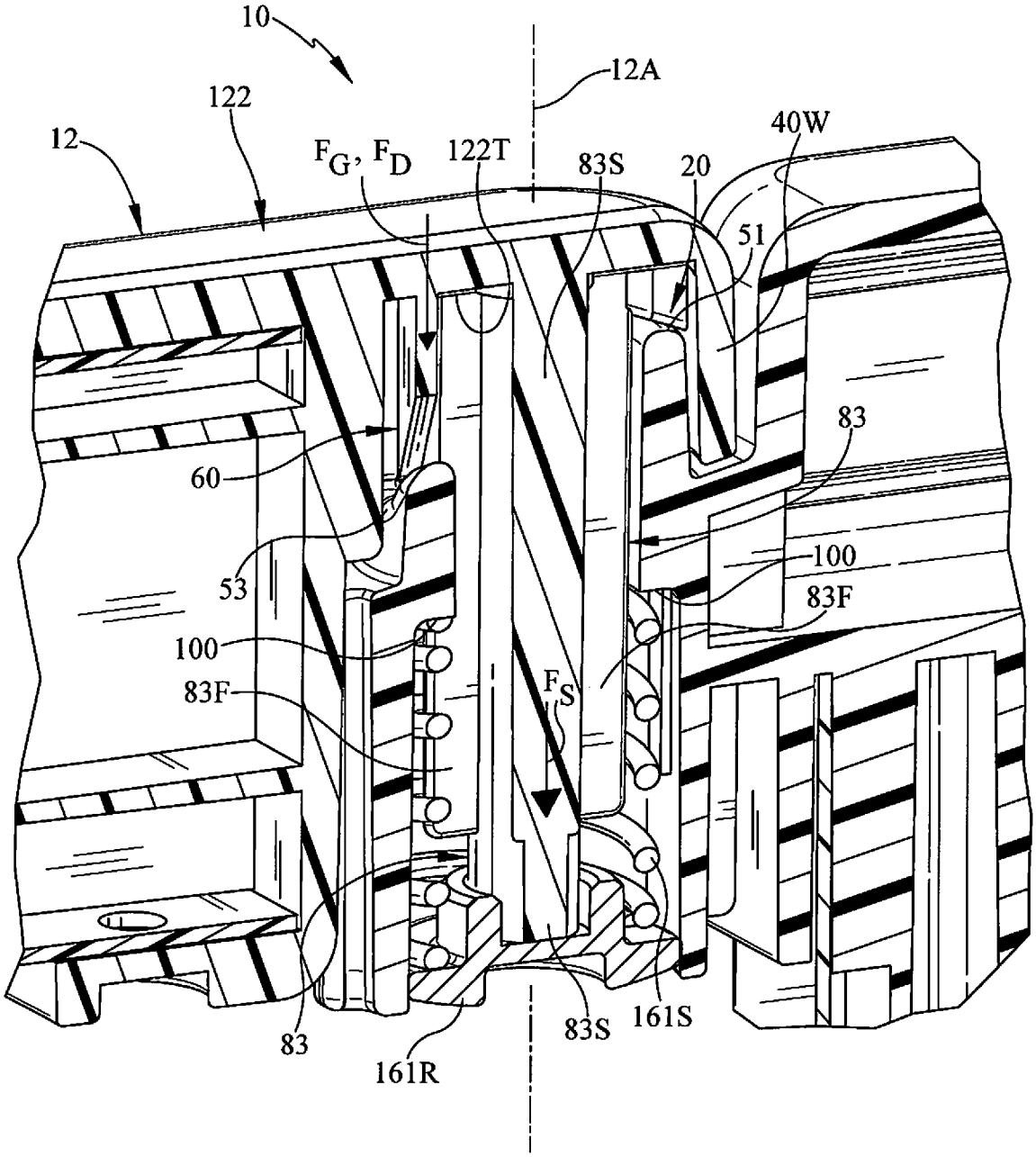
FIG. 16 is an enlarged view of a portion of the assembly of FIG. 15 from a different point of view showing extension of the movable cam follower into the upwardly opening follower-receiver notch included in the stationary cam.

Gate-panel bracket 80 includes a body 81, an attachment flange 82, and a mount pin 83 as shown below in FIG. 10. Body 81 is shaped to define a cavity that receives a top rail 12T of gate 12 to couple gate-panel bracket 80 to gate 12. Attachment flange 82 is included in movable pivot 40 and extends toward first wall panel 161 of gate mount 16. Mount pin 83 is also included in movable pivot 40 and extends downwardly from attachment flange 82 and engages stationary pivot support 30 as shown in FIGS. 15 and 16.

Gate-mount bracket 70 includes a body 71 and an attachment flange 72 as shown in FIG. 10. Body 71 is shaped to define a cavity that receives a portion of top beam 16B of gate mount 16 to couple gate-mount bracket 70 to gate mount 16. Attachment flange 72 extends toward gate 12 and is formed to include a pin-receiving space 83R as shown in FIG. 11. Mount pin 83 is configured to extend into the pin-receiving space 83R to couple gate-panel bracket 80 to gate-mount bracket 70.

Gate mount 16 further includes a retainer 161R and a pivot-load spring 161S as shown below in FIG. 10. Retainer 161R is mounted on a lower end 83L of fin-support rod 83S of mount pin 83 and arranged to lie in spaced-apart relation to attachment flange 82 of the gate-panel bracket 80. Pivot-load spring 161S winds around mount pin 83 within the pin-receiving space 83R. The pivot-load spring 161S acts against a flange 100 formed in stationary pivot support 30 to apply a downward force ($F_S$) on retainer 161R that is transferred as Force ($F_D$) to encourage gate-panel bracket 80 and gate-mount bracket 70 to move toward one another. An upper end of pivot-load spring 161S acts against flange 100 and a lower end of pivot-load spring 161S as shown in FIGS. 15 and 16. Pivot-load spring 162S is a helical compression spring.

Attachment flange 82 of gate-panel bracket 80 includes a plurality of fins 83F coupled to mount pin 83. Movable cam follower 60 extends downwardly from attachment flange 82. The plurality of fins 83F are spaced around mount pin 83 as shown, for example, in FIGS. 8 and 11 and extend outwardly from a fin-support rod 83S included in fin-support rod 83S to engage a cylindrical inner surface of attachment flange 72 of gate-mount bracket 70 when mount pin 83 is received within the pin-receiving space 83R as shown, for example, in FIGS. 15 and 16.

Attachment flange 72 of gate-mount bracket 70 supports a stationary cam 50 configured to cooperate with movable cam follower 60 to guide gate 12 toward the stationary CLOSED position or the OPENED position depending on the angle of gate 12 relative to gate mount 16. Stationary cam 50 includes a close-assist surface 52, a rest surface 53, and a peak 54 between close-assist surface 52 and rest surface 53 as shown in FIG. 11. Movable cam follower 60 is configured to engage stationary cam 50 under a gravity load and a down force generated by pivot-load spring 161S as gate 12 pivots relative to gate mount 16 about vertical gate-pivot axis 12A. A peak 54 is formed on each side of stationary cam 50.

The upper hinge 16U is in a closed configuration when cam follower 60 is aligned with a lowest point of the close-assist surface 52 relative to the peak 54. In one example, the close-assist surface 52 is formed to lie adjacent to a recess 53 at the lowest point to receive cam follower 60 and retain upper hinge 16U in the closed configuration. Upper hinge 16U is arranged in the opened configuration when gate 12 is angled relative to gate mount 16 so that movable cam follower 60 is positioned on the rest surface 53 of stationary cam 50. In one example, upper hinge 16U is arranged in the opened configuration when gate 12 pivots away from gate mount 16 at an angle greater than about 90 degrees.

The pivot-load spring 161S urges gate-panel bracket 80 toward gate-mount bracket 70 so that the movable cam follower 60 always slides downhill along the close-assist surface 52 to rest surface 53 away from the peak 54. In one example, the movable cam follower 60 cooperates with the close-assist surface 52 to encourage upper hinge 16U to move toward the closed configuration when gate 12 is angled less than 90 degrees relative to gate mount 16. Conversely, movable cam follower 60 cooperates with an open-assist surface 51 to retain the upper hinge 16U in the opened configuration when gate 12 is angled greater than 90 degrees relative to gate mount 16.

The invention claimed is:

1. A gate unit comprising a gate mount adapted to mate with a frame bordering a passageway, the gate mount including a gate hinge including a stationary pivot support and a movable pivot that is mated in rotative bearing engagement with the stationary pivot support to establish a gate-pivot axis, a gate coupled to the movable pivot of the gate hinge for pivotable movement with the movable pivot about the gate-pivot axis between a closed position closing a walkway passage formed in the gate mount to block movement of a person through the walkway passage and an opened position opening the walkway passage to allow movement of a person through the walkway passage, and a gate-motion controller including a stationary cam coupled to the stationary pivot support and a cam follower coupled to the gate to pivot therewith about the gate-pivot axis and arranged to extend downwardly to engage and ride on the stationary cam during pivoting movement of the gate about the gate-pivot axis between the opened and closed positions, wherein the stationary cam includes a negatively sloping gate-opener ramp, a positively sloping gate-closer ramp, and a high-point peak provided at a junction between the negatively sloping gate-opener ramp and the positively sloping gate-closer ramp, wherein the negatively sloping gate-opener ramp extends downwardly away from the high-point peak and away from the gate and the positively sloping gate-closer ramp extends upwardly toward the high-point peak and away from the gate, wherein the cam follower engages and rides on the positively sloping gate-closer ramp during pivotable movement of the gate about the gate-pivot axis from the closed position toward the opened position, and wherein the cam follower engages the negatively sloping gate-opener ramp upon pivotable movement of the gate to the opened position to retain the gate in a predetermined opened position, wherein the negatively sloping gate-opener ramp has a first slope adjacent to the high-point peak and relative to the gate pivot axis, and wherein the positively sloping gate-closer ramp has a second slope adjacent to the high-point peak and relative to the gate pivot axis, the second slope being greater than the first slope, and wherein the gate mount further includes a pivot-load spring having a lower end acting against the movable pivot and an upper end acting against the stationary pivot support to generate a force applied to the movable pivot to urge the cam follower to engage and ride on the stationary cam during pivoting movement of the gate about the gate-pivot axis.

2. The gate unit of claim 1, wherein the negatively sloping gate-opener ramp engages the cam follower to retain the gate in a first opened position in response to pivoting movement of the gate about the gate-pivot axis from the closed position through an angle of about 90 degrees in a clockwise direction and to retain the gate in a second opened position in response to pivoting movement of the gate about the gate-pivot axis from the closed position through an angle of about 90 degrees in a counterclockwise direction, wherein the stationary cam further includes a follower-receiver notch configured to receive the cam follower upon arrival of the gate at the closed position to retain the gate temporarily in the closed position, and wherein the gate-closer ramp includes a positively sloping first segment interconnecting the follow-receiver notch and the negatively sloping gate-opener ramp and engaging the cam follower during pivoting motion of the gate in the clockwise direction from the closed position to the first opened position and a positively sloping second segment interconnecting the follower-receiver notch and the negatively sloping gate-opener ramp and engaging the cam follower during pivoting motion of the gate in the counterclockwise direction from the closed position to the second opened position.

3. The gate unit of claim 2, wherein the negatively sloping gate-opener ramp comprises an inclined U-shaped surface including a high-elevation first end coupled to the positively sloping first segment of the gate-closer ramp, a high-elevation second end coupled to the positively sloping second segment of the gate-closer ramp, and a relatively lower low-elevation mid-section located midway between the high-elevation first and second ends.

4. The gate unit of claim 3, wherein each of the positively sloping first and second segments is curved and includes a concave inner edge arranged to face toward the gate-pivot axis.

5. The gate unit of claim 3, wherein the follower-receiver notch and the relatively lower low-elevation mid-section of the inclined U-shaped surface are diametrically opposed to one another along a reference line arranged to extend through the gate-pivot axis.

6. The gate unit of claim 2, wherein the stationary cam is a tube formed to include a lower tube end coupled to the stationary pivot support, an upper tube end arranged to face toward the cam follower and formed to include the follower-receiver notch, the gate-closer ramp, and the negatively sloping gate-opener ramp, and a central pin-receiving passageway extending along the gate-pivot axis from the upper tube end to the lower tube end and wherein the movable pivot of the gate hinge includes a mount pin arranged to extend along the gate-pivot axis in a downward direction into the central pin-receiving passageway and coupled to the gate to rotate about the gate-pivot axis during pivotable movement of the gate about the gate-pivot axis.

7. The gate unit of claim 6, wherein the gate includes a swinging panel and a pivot mount coupled to the swinging panel and the mount pin includes an upper pin end coupled to the pivot mount and a lower pin end arranged to extend into the central pin-receiving passageway formed in the stationary cam.

8. The gate unit of claim 1, wherein the positively sloping gate-closer ramp includes a first segment coupled to a first end of the negatively sloping gate-opener ramp and a second segment coupled to an opposite second end of the negatively sloping gate-opener ramp.

9. The gate unit of claim 8, wherein the cam follower engages and rides on the first segment of the positively sloping gate-closer ramp during clockwise movement of the gate about the gate-pivot axis from the closed position to a first opened position, the cam follower engages and rides on the second segment of the positively sloping gate-closer ramp during counterclockwise movement of the gate about the gate-pivot axis from the closed position to a second opened position, and the cam follower engages and rides on the negatively sloping gate-opener ramp during counterclockwise movement of the gate about the gate-pivot axis from the first opened positon to the closed position and during clockwise movement of the gate about the gate-pivot axis from the second opened position to the closed position.

10. The gate unit of claim 9, wherein the stationary cam is formed to include a follower-receiver notch between the first and second segments for receiving the cam follower therein upon arrival of the gate at the closed position so that the gate is retained in the closed position.

11. The gate unit of claim 10, wherein each of the first and second segments and the negatively sloping gate-opener ramp is curved.

12. The gate unit of claim 11, wherein each of the first segment, the second segment, and the negatively sloping gate-opener ramp includes a concave inner surface arranged to face toward the gate-pivot axis.

13. The gate unit of claim 11, wherein each of the first and second segments has a low-elevation end and a relatively higher high-elevation end, the high-elevation end of the first segment is coupled to the first end of the negatively sloping gate-opener ramp, the high-elevation end of the second segment is coupled to the opposite second end of the negatively sloping gate-opener ramp to locate the gate-pivot axis midway between the high-elevation ends of the first and second segments, and the low-elevation ends of the first and second segments are arranged to lie in spaced-apart relation and close proximity to one another to form the follower-receiver notch therebetween for receiving the cam follower therein upon arrival of the gate at the closed position so that the gate is retained in the closed position.

14. The gate unit of claim 13, wherein each of the first and second segments is curved.

15. The gate unit of claim 13, wherein the negatively sloping gate-opener ramp is curved.

16. The gate unit of claim 1, wherein the stationary cam is a tube formed to include a lower tube end coupled to the stationary pivot support, an upper tube end arranged to face toward the cam follower and formed to include the negatively sloping gate-opener ramp and the positively sloping gate-closer ramp, and a central pin-receiving passageway extending along the gate-pivot axis from the upper tube end to the lower tube end and wherein the movable pivot of the gate hinge includes a mount pin arranged to extend along the gate-pivot axis in a downward direction into the central pin-receiving passageway and coupled to the gate to rotate about the gate-pivot axis during pivotable movement of the gate about the gate-pivot axis.

17. The gate unit of claim 16, wherein the gate includes a swinging panel and a pivot mount coupled to the swinging panel and the mount pin includes an upper pin end coupled to the pivot mount and a lower pin end arranged to extend into the central pin-receiving passageway formed in the stationary cam.

18. The gate unit of claim 17, wherein the movable pivot further includes a curved pin-surround wall coupled to the pivot mount and centered on the gate-pivot axis partly to surround the upper pin end of the mount pin, the curved pin-surround wall includes a concave inner surface arranged to face toward the upper pin end of the mount pin and mate in rotative bearing engagement with a curved exterior surface of the stationary cam during pivoting movement of the gate about the gate-pivot axis between the opened and closed positions.

19. The gate unit of claim 17, wherein the pivot mount includes a horizontally extending top wall, the upper pin end of the mount pin is coupled to an underside of the horizontally extending top wall to lie in laterally spaced-apart relation to the gate, and the cam follower is coupled to the underside of the horizontally extending top wall and is arranged to lie between the gate and the mount pin and to extend downwardly away from the horizontally extending top wall to engage each of the negatively sloping gate-opener ramp and the positively sloping gate-closer ramp during pivoting movement of the gate about the gate-pivot axis between the opened and closed positions.

20. The gate unit of claim 19, wherein the high-point peak is associated with a transition position of the gate between the opened and closed positions, the cam follower engages the negatively sloping gate-opener ramp when the gate occupies the opened position to retain the gate in the opened position, the cam follower is arranged to ride up the negatively sloping gate-opener ramp, pass over the high-point peak associated with the transition position of the gate, and then slide downwardly on the positively sloping gate-closer ramp during rotation of the gate about the gate-pivot axis from the opened position to the closed position.

21. The gate unit of claim 19, wherein the stationary cam is formed to include a follower-receiver notch associated with the closed position of the gate, and the positively sloping gate-closer ramp is arranged to extend upwardly from the follower-receiver notch to the high-point peak associated with the transition position of the gate, and the cam follower is arranged to slide downwardly on the positively sloping gate-closer ramp during rotation of the gate about the gate-pivot axis from the opened position to the closed position and extend into the follower-receiver notch upon arrival of the gate at the closed position.

22. A gate unit comprising a gate mount adapted to mate with a frame bordering a passageway, the gate mount including a gate hinge including a stationary pivot support and a movable pivot that is mated in rotative bearing engagement with the stationary pivot support to establish a gate-pivot axis, a gate coupled to the movable pivot of the gate hinge for pivotable movement with the movable pivot about the gate-pivot axis between a closed position closing a walkway passage formed in the gate mount to block movement of a person through the walkway passage and an opened position opening the walkway passage to allow movement of a person through the walkway passage, and a gate-motion controller including a stationary cam coupled to the stationary pivot support and a cam follower coupled to the gate to pivot therewith about the gate-pivot axis and arranged to extend downwardly to engage and ride on the stationary cam during pivoting movement of the gate about the gate-pivot axis between the opened and closed positions, wherein the stationary cam is a tube formed to include a central pin-receiving passageway extending along the gate-pivot axis and wherein the movable pivot of the gate hinge includes a mount pin arranged to extend along the gate-pivot axis in a downward direction into the central pin-receiving passageway and coupled to the gate to rotate about the gate-pivot axis during pivotable movement of the gate about the gate-pivot axis, and wherein the mount pin includes an elongated fin-support rod and several fins coupled to a cylinder-shaped exterior surface of the elongated fin-support rod and arranged to extend radially outwardly away from the cylinder-shaped exterior surface and the gate-pivot axis to mate in rotative bearing engagement with a cylinder-shaped inner surface of the stationary cam that provides a boundary of the pin-receiving passageway formed in the stationary cam.

23. The gate unit of claim 22, wherein the movable pivot further includes a retainer coupled to the mount pin and the gate mount further includes a compression spring having an upper end arranged to engage the stationary pivot support and a lower end arranged to engage the retainer to generate a downward force that is applied to the movable pivot to urge the cam follower into engagement with the stationary cam.

24. The gate unit of claim 23, wherein the compression spring is arranged to wind around the mount pin.

25. The gate unit of claim 23, wherein the compression spring is arranged to underlie the stationary cam.

26. The gate unit of claim 22, wherein the gate mount further includes a pivot-load compression spring arranged to wind helically around the mount pin and is formed to include an upper end acting against the stationary pivot support and a lower end acting against a retainer included in the movable pivot and coupled to the lower pin end of the mount pin.

* * * * *